US005972201A

United States Patent [19]

Goolsby et al.

[11] Patent Number: 5,972,201

[45] Date of Patent: Oct. 26, 1999

[54] HYDROCARBON CONVERSION CATALYST ADDITIVES AND PROCESSES

[75] Inventors: Terry L. Goolsby; Maurice M. Mitchell, both of Ashland, Ky.

[73] Assignee: Marathon Ashland Petroleum LLC

[21] Appl. No.: 08/804,856

[22] Filed: Feb. 24, 1997

Related U.S. Application Data

[63] Continuation of application No. 08/372,747, Jan. 13, 1995, abandoned.

[51] Int. Cl.[6] ..... C10G 9/00; C10G 29/04; C10B 55/00; B01J 23/90

[52] U.S. Cl. ..... 208/106; 208/52 CT; 208/140; 208/251 R; 208/253; 502/21; 502/516; 502/521

[58] Field of Search ..... 208/106, 52 CT, 208/140, 251 R, 253; 502/21, 516, 521

[56] References Cited

U.S. PATENT DOCUMENTS

| | | | |
|---|---|---|---|
| 2,635,749 | 4/1953 | Cropper et al. | 208/52 CT |
| 2,651,599 | 9/1953 | Watts et al. | 208/52 CT |
| 2,673,187 | 3/1954 | Stine et al. | 208/52 CT |
| 4,148,714 | 4/1979 | Nielsen et al. | 208/52 CT |
| 4,193,891 | 3/1980 | McKay | 208/52 CT |
| 4,198,317 | 4/1980 | Bertus et al. | 208/52 CT |
| 4,237,312 | 12/1980 | Stapp | 560/246 |
| 4,238,362 | 12/1980 | Bertus et al. | 208/52 CT |
| 4,257,876 | 3/1981 | McKay | 208/120 |
| 4,257,919 | 3/1981 | Roberts et al. | 252/461 |
| 4,263,130 | 4/1981 | Bertus et al. | 208/52 CT |
| 4,279,735 | 7/1981 | Bertus et al. | 208/113 |
| 4,359,379 | 11/1982 | Ushio et al. | 208/120 |
| 4,406,773 | 9/1983 | Hettinger, Jr. et al. | 502/38 |
| 4,477,335 | 10/1984 | Benslay | 502/41 |
| 4,946,519 | 8/1990 | Honda et al. | 148/307 |
| 5,041,172 | 8/1991 | Tokunaga et al. | 148/302 |
| 5,250,482 | 10/1993 | Doctor | 502/516 |
| 5,260,240 | 11/1993 | Guthrie et al. | 502/21 |

*Primary Examiner*—Mark L. Bell
*Assistant Examiner*—Patricia L. Hailey
*Attorney, Agent, or Firm*—Richard D. Stone

[57] ABSTRACT

Magnetic separation of fluid cracking catalyst and magnetic hooks can be improved by adding antimony, in the feed or during catalyst manufacture, to enhance the magnetic susceptibility, thus increasing the separation efficiency of the older less active fluid cracking catalyst from the more desirable fraction for recycle. Antimony can also be used as a tag for determination of age distribution of said catalyst. Concentration levels of 0.005–15 wt. % antimony (Sb) on the catalyst or sorbent are preferred. The invention is particularly preferred on catalyst and sorbents which comprise at least about 0.001 wt. %, more preferably above about 0.01 wt. % iron, because the antimony has been found to enhance the magnetic susceptibility of iron-containing particulates.

12 Claims, 5 Drawing Sheets

HYDROCARBON CONVERSION CATALYST ADDITIVES AND PROCESSES

CROSS REFERENCE TO RELATED APPLICATIONS

This application is a continuation of application Ser. No. 08/372,747, filed Jan. 13, 1995, now abandoned. Cross references to related application, U.S. patent application Ser. No. 07/686,068, filed Apr. 16, 1991, now abandoned; and U.S. patent application Ser. No. 07/602,455, filed Oct. 19, 1990, now U.S. Pat. No. 5,198,098, relate to the general field of the present invention.

BACKGROUND OF INVENTION

I. Field of the Invention

The present invention relates to processes, apparatus, and compositions for the enhancement of hydrocarbon conversion processes, particularly processes involving the contacting of hydrocarbon feeds with particulates such as catalyst and sorbents, especially fluid catalytic cracking processes. The RCC® heavy oil cracking process, generally classified in U.S. Patent Class 208, International Patent Classification C10G11.

II. Description of the Prior Art

In an FCC process, metals accumulate onto the catalyst, the catalyst becomes deactivated with time and in order to maintain FCC unit activity, a fraction of the unit inventory is withdrawn and fresh catalyst is added. The spent catalyst (withdrawn catalyst) contains a dynamic mixture of catalyst particles from very old/high metals, low activity to newer/low metals high activity. In order to produce a separation using magnetic separation techniques, the catalyst must exhibit magnetic properties, notably magnetic susceptibility. As metals are deposited onto the catalyst particles over a period of time, the magnetic susceptibility of those catalyst particles increases, FIG. 2, and magnetic separation can be achieved with the MagnaCat® Process. When antimony (Sb) is added to a FCC process unit, it is laid down onto the catalyst particles and reacts with the metals present (notably iron) on the particle. It has been demonstrated that, with the addition of antimony, the magnetic susceptibility of these catalyst particles increase and an enhanced magnetic separation can be obtained. The antimony can also be used as a tag for determination of age distribution of said catalyst.

Antimony has frequently been added to cracking catalyst to "passivate" the catalyst and reduce the production of hydrogen and other undesirable light gaseous products, e.g., in U.S. Pat. No. 4,459,366, U.S. Pat. No. 4,457,693, U.S. Pat. No. 3,711,422, and U.S. Pat. No. 4,334,979.

Magnetic separation has been taught by a number of U.S. patents such as U.S. Pat. No. 4,406,773, U.S. Pat. No. 5,147,527, U.S. Pat. No. 5,106,486, U.S. Pat. No. 5,171,424, and U.S. Pat. No. 5,230,869 to Hettinger et al., which teaches the removal of inactive catalyst and sorbents from mixtures of active and inactive particulates so that the active particulates can be recovered for reuse.

However, it has not been previously taught that the passivating advantage of antimony on conversion on catalyst and sorbents can be coupled with the enhanced magnetic susceptible of metals such as iron in the presence of antimony to obtain the advantages of passivation and selective recovery of more active particulate.

SUMMARY OF THE INVENTION

I. General Statement of the Invention

According to the present invention, magnetic separation of fluid cracking catalyst and magnetic hooks can be improved by adding antimony, in the feed or during catalyst manufacture, to enhance the magnetic susceptibility, thus increasing the separation efficiency of the older less active fluid cracking catalyst from the more desirable fraction for recycle. Antimony can also be used as a tag for determination of age distribution of said catalyst.

Concentration levels of 0.005–15 wt. % antimony (Sb) on the catalyst or sorbent are preferred. The invention is particularly preferred on catalyst and sorbents which comprise at least about 0.001 wt. %, more preferably above about 0.01 wt. % iron, because the antimony has been found to enhance the magnetic susceptibility of iron-containing particulates.

Antimony is added to particulates such as sorbents and catalysts, which are contacted with hydrocarbon feeds in order to produce lower molecular weight products, e.g., to produce transportation fuels such as jet fuel, kerosene, gasoline, diesel fuel, etc. from crude oil. The antimony has been found to increase the magnetic susceptibility of particles, particularly those which contain iron, and most preferably in the presence of iron and absence of nickel as shown in FIG. 1, item 3.

Particularly preferred embodiments of the invention is a process for the conversion of the hydrocarbon feed into lower molecular weight products by contacting feed at above ambient temperatures with particulates comprising catalyst and/or sorbents in a contactor to produce said lower molecular weight products together with a mixture of active and spent particulates is improved by the steps comprising in combination: (a) adding antimony to said feed and/or to at least a portion of said particulates so that said antimony increases the magnetic susceptibility of a portion of said particulates; (b) subjecting said mixture of said particulates to magnetic separation in a magnetic separator which preferentially removes particles of said particulates having higher magnetic susceptibility than the average magnetic susceptibility of said particulates taken as a whole, to form at least a high magnetic susceptibility portion of particulates and a low magnetic susceptibility portion of particulates; and (c) recycling one of said portions back for contact with additional quantities of said feed.

Particularly preferred is a process as described above wherein at least a portion of the particulates in the mixture comprises iron, the combination of antimony plus iron having been found to have synergistic magnetic properties according to the discovery of the invention.

Also particularly preferred is a process in which at least a portion of the antimony is added by mixing in the feed so as to cause said antimony to deposit gradually over time onto the catalyst. (Sorbent may also be used according to the techniques of U.S. Pat. No. 4,237,312 in place of catalyst or intermixed with catalyst.)

The antimony can be included in the particulate catalyst or sorbent during the manufacture of the particulate; e.g. by compounding it, or by ion exchanging onto the surface of the catalyst, or dipping the catalyst into a solution or suspension of antimony compounds during manufacture of the catalyst or sorbent.

The invention is preferred for situations where the particulates are a high valued specialty catalyst or additive which it is desired to recover for recycle.

The invention embodies a system for the conversion of hydrocarbon feed into lower molecular weight products comprising in combination: a) a source of antimony-containing moiety; b) a contacting zone wherein said feed can be contacted with a particulate sorbent or catalyst for hydrocarbon conversion purposes; c) a hydrocarbon feed which gradually exhausts the activity of said particulate over repeated contacts with said hydrocarbon feed; and d) a magnetic separator operably connected to separate at least a portion of said particulates after contact with said feed; said separators separating said particulates into at least a portion having a magnetic susceptibility greater than the average aforesaid mixture and at least a second portion having a magnetic susceptibility lower than the average aforesaid mixture.

The invention embodies a system for the conversion of hydrocarbon feed into lower molecular weight products comprising in combination: a) a source of antimony-containing moiety decomposable under FCC® conditions; b) a contacting zone wherein said feed can be contacted with a particulate sorbent or catalyst for hydrocarbon conversion purposes; c) a hydrocarbon feed which gradually exhausts the activity of said particulate (sorbent or catalyst), over repeated contacts with said hydrocarbon feed; d) a magnetic separator operably connected to separate at least a portion of said particulates after contact with said feed; said separators separating said particulates into at least a portion having a magnetic susceptibility greater than the average aforesaid mixture and at least a second portion having a magnetic susceptibility lower than the average aforesaid mixture.

Particularly preferred for the invention are compositions of matter comprising with one or more of zeolite, kaolin, alumina and/or silica, and 0.1–10 wt % antimony suitable for cracking hydrocarbon feedstocks containing nickel and/or iron, but particularly suitable for feedstocks containing iron in the absence of nickel.

Sb Compounds:

Sb can be added to feed in the form of antimony acetate (a commercial 97% composition, is available); Nalco colloidal antimony compositions available from Nalco Chemical Co.; antimony pentoxide and the other antimony compounds described in the various patents of Phillips Petroleum Company; and any other compound of antimony which does not deleteriously affect the cracking process or the magnetic separation.

Sb Addition:

As described above, the antimony can be impregnated into the catalyst during its manufacture, can be ion exchanged onto the surface of the catalyst before use, can be dipped or otherwise coated onto the surface before use, or can otherwise be present in virgin catalyst as it is introduced into the FCC or RCC cracking system. Amounts of antimony on catalyst are shown in Table III. The invention is useful with a wide variety of conventional catalyst and sorbents used for hydrocarbon conversion.

Antimony can be incorporated into a catalyst during manufacture in order to "tag" that particular catalyst. This is especially important when attempting to separate out and recover a particularly valuable catalyst, e.g. a ZSM-5 or other specialty catalyst or catalyst additive, as in U.S. Ser. No. 08/326,982 filed Oct. 21, 1994, now U.S. Pat. No. 5,538,624. For example, if the ZSM-5 contains substantial amounts of catalyst, and if nickel accumulates along with iron on the surface of the catalyst during repeated cracking cycles, that ZSM-5-containing catalyst can readily be recovered by magnetic separation because of the high magnetic susceptibility imparted by the presence of all three metals in combination.

Alternatively, the Sb can be injected into the feed continuously or periodically or can be injected into the FCC®, e.g. into the hot catalyst return line, or the recycle line from the magnetic separator back to the FCC® unit.

Magnetic Separation:

The magnetic separator can be of the HGMS type (high gradient magnetic separator), the RERMS type (rare earth roller magnetic separator), or other permanent magnet type, or electromagnetic magnets installed in roller-type magnetic separators, or can be of the electrostatic variety, as described in the text by Svoboda entitled *Magnetic Methods for the Treatment of Minerals.*

II. Utility of the Invention

The present invention is useful for a wide variety of hydrocarbon conversion processes including, without limitation, fluid catalytic cracking, the RCC® heavy oil conversion process, hydrotreating, catalytic reforming, and various sorbent processes such as the MRS™ process of Ashland Oil, Inc. The invention permits the separation of a high activity sorbent or catalyst or other particulate portion from a mixture comprising spent particles and active particles. The active portion can be recycled back to a contactor for contact with additional quantities of hydrocarbon feeds to be converted. Also, the invention permits the preferential removal of particularly high value or particularly specialized particles which have been added to a particle mixture for optimum conversion of the hydrocarbon feed.

DESCRIPTION OF THE PREFERRED EMBODIMENTS

EXAMPLE 1

Figure 1:
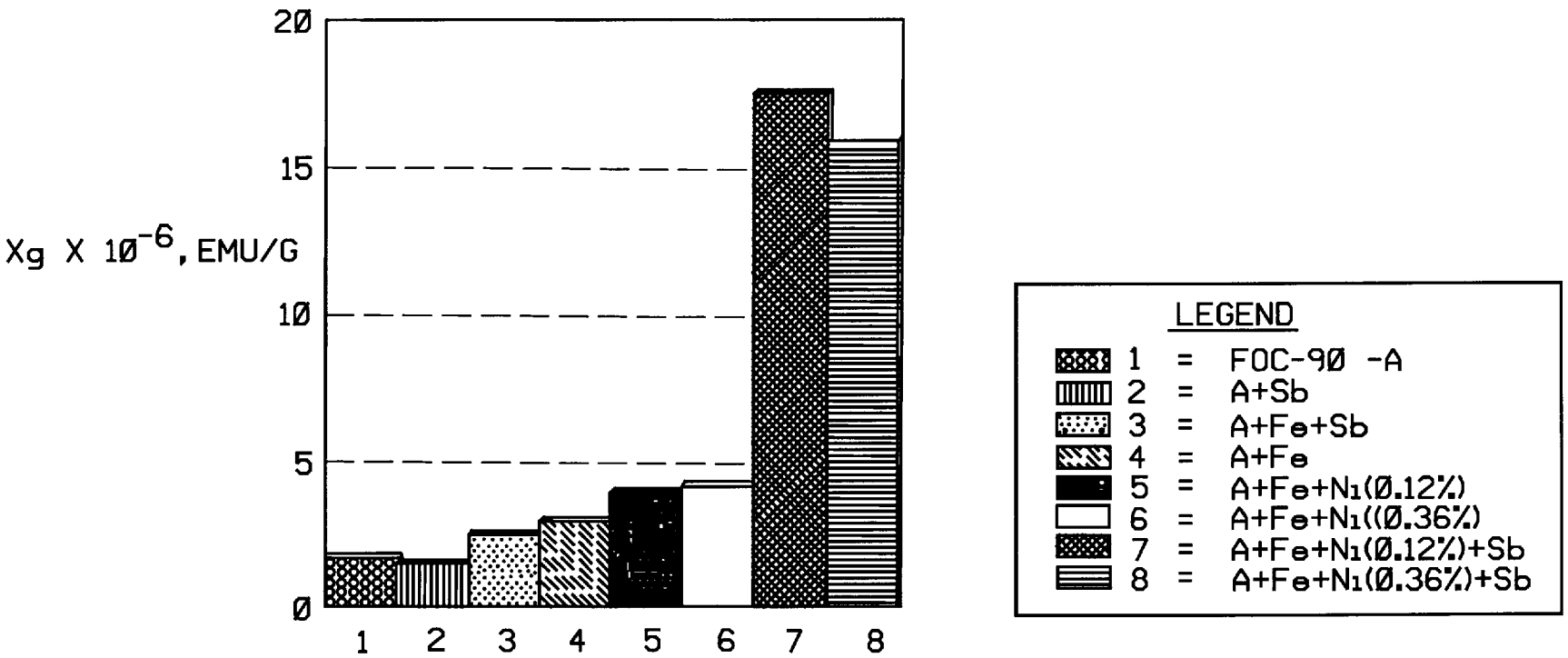
FIG. 1 illustrates the magnetic susceptibility ($X_g \times 10^{-6}$ emu/g) and demonstrates the discovery of the invention that antimony increases magnetic susceptibility, but that it is much more increased by antimony plus iron or nickel, and particularly preferred is most increased by iron plus nickel, together with antimony.
Figure 2:
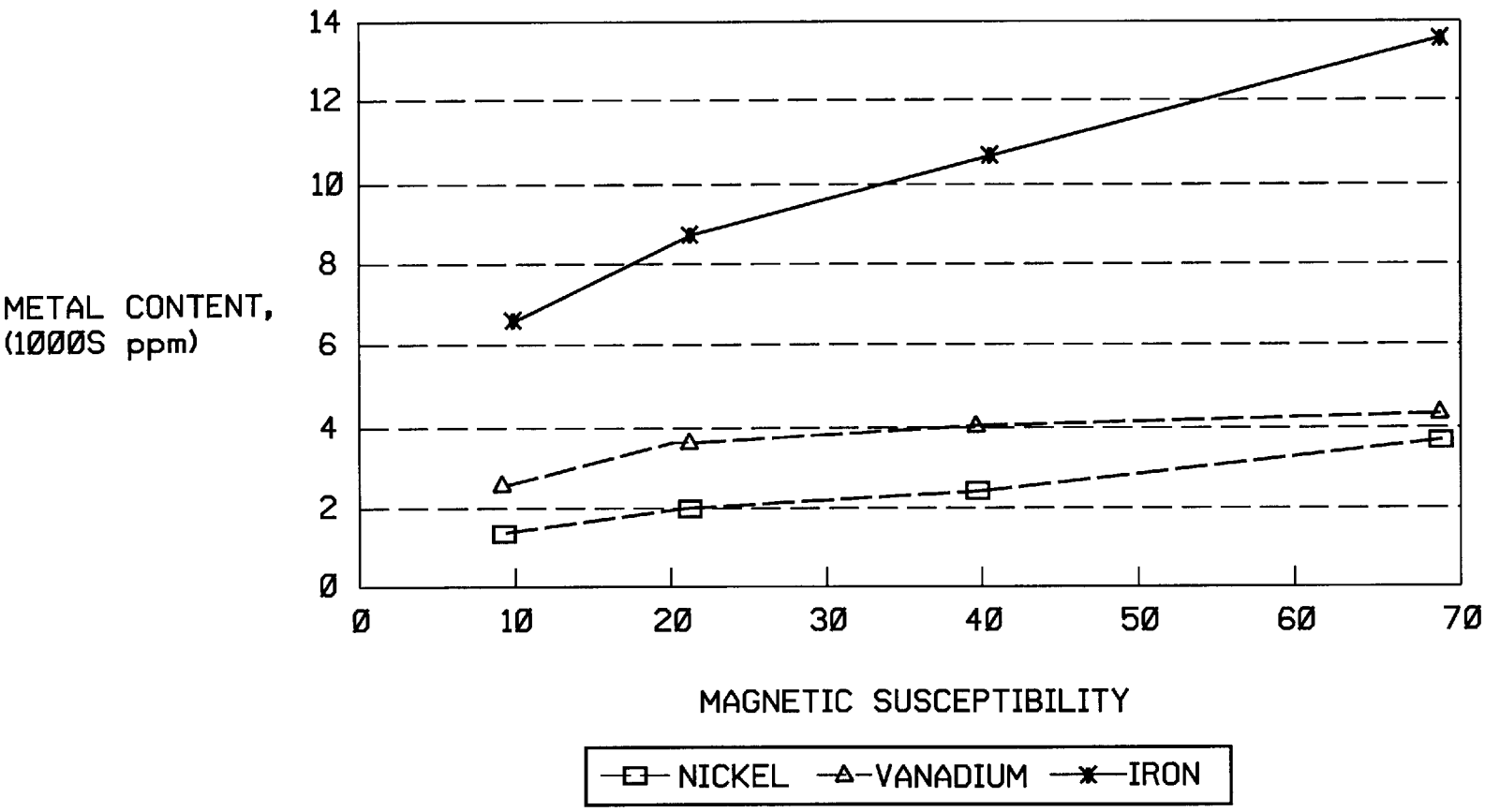
FIG. 2 is comparative and indicates that nickel, vanadium and iron each greatly increase the magnetic susceptibility as they accumulate on the catalyst particles.
Figure 3:
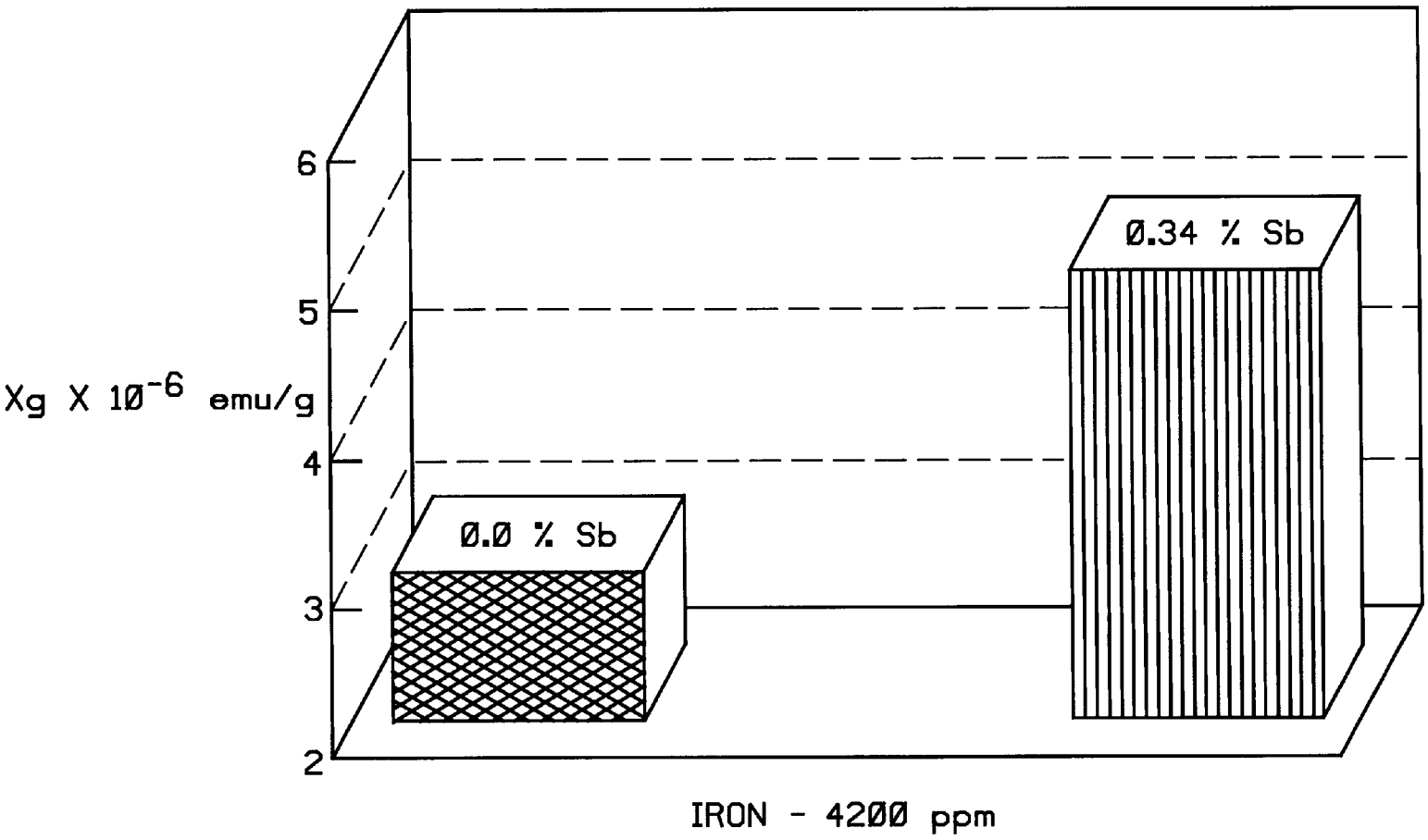
FIG. 3 is a bar graph again versus magnetic susceptibility where iron is 4200 ppm on each of the two samples, and the left hand run has 0% antimony, whereas the right hand run has 0.34% antimony. Note particularly how a relatively small addition of antimony sharply increases magnetic susceptibility.
Figure 4:
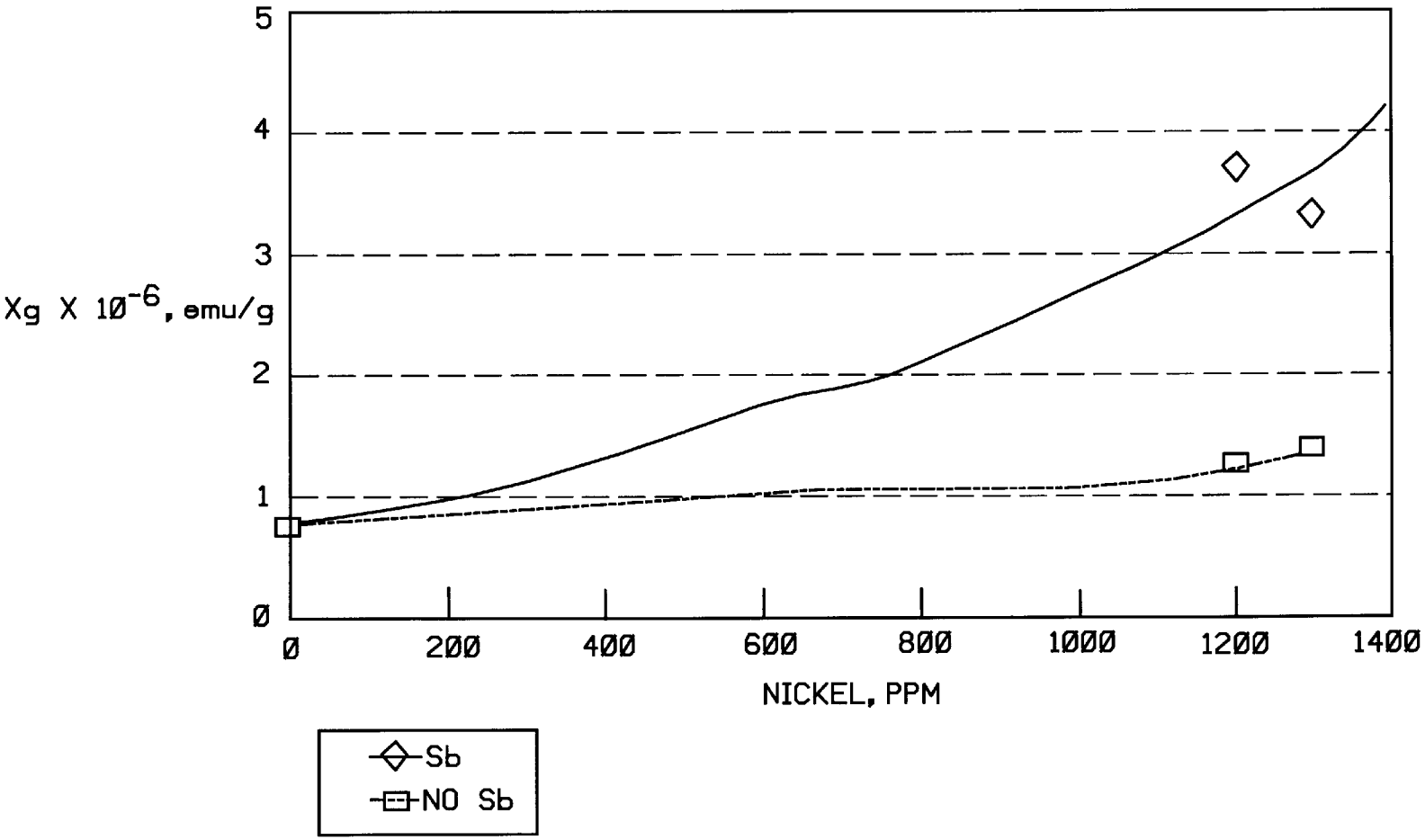
FIG. 4 shows the effect of antimony on nickel. As the amount of nickel content on the catalyst increases, magnetic susceptibility increases with the addition of antimony, yet the magnetic susceptibility increases slightly in the absence of antimony as the nickel content increases.
Figure 5:
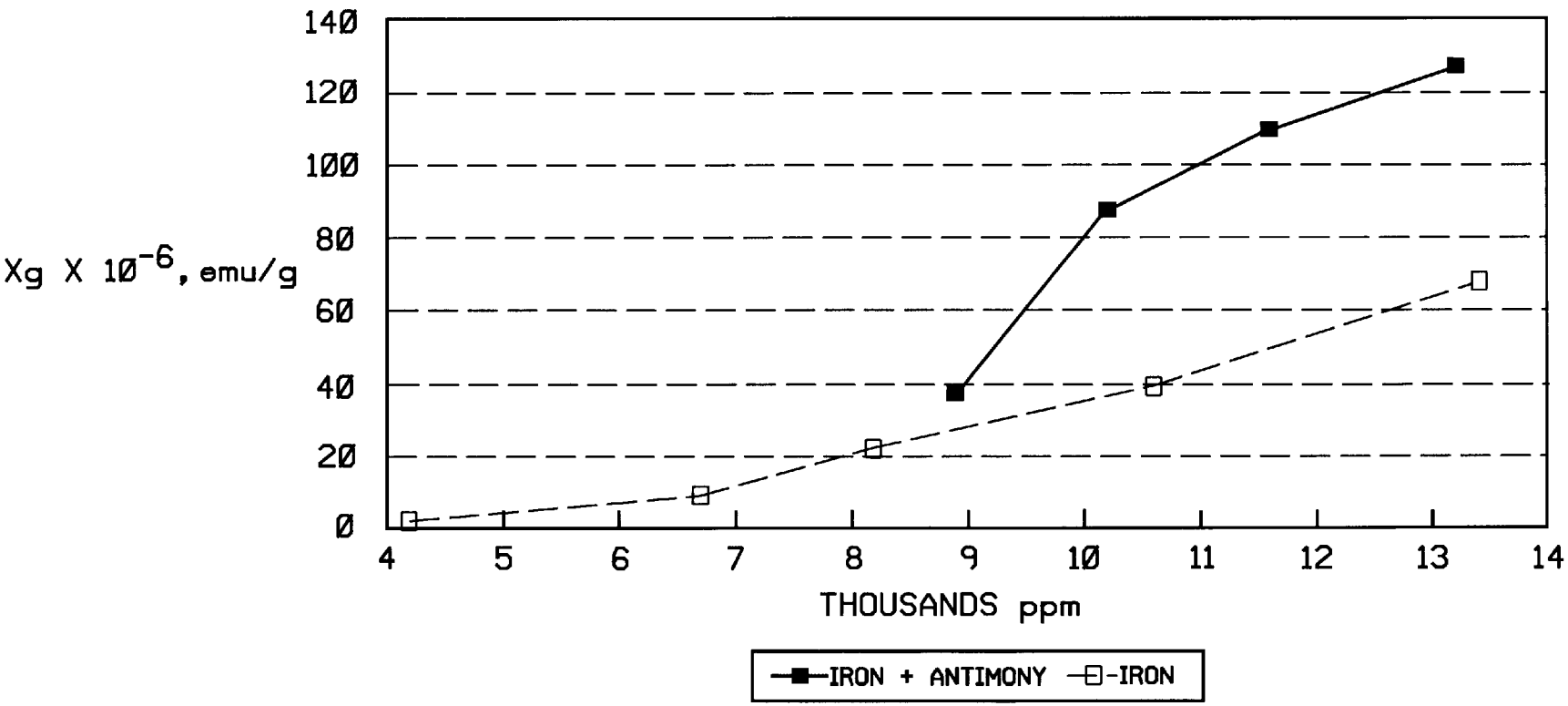
FIG. 5 shows how an extremely small amount of antimony sharply increases the magnetic susceptibility of the catalyst in which it is either contained, or on which it has become deposited.

(The invention adding Sb to hydrocarbon FCC feed so that it deposits on to the catalyst over time)

A commercial catalyst, FOC90, available from Akzo Chemicals, Inc., a division of Akzo Nobel, is employed in a conventional fluid catalytic cracking unit (FCC) of a design by UOP, M. W. Kellogg, or other designer. The catalyst circulates successively through a riser into a recovery section and then into a regenerator where carbon is burned off by treatment with air and/or $CO_2$. The decoked catalyst is then recycled back to the riser for contact with additional quantities of a heavy oil feedstock which contains approximately 10 ppm nickel plus 5 ppm iron. From this stream of catalyst, there is continuously or intermittently withdrawn a portion which is sent to a magnetic separator of the type described in U.S. Pat. No. 5,147,527. The magnetic separator operates conventionally and removes a high metal-contaminated portion of the catalyst before recycling the remaining lower metal catalyst back to the cracking cycle.

When a 1:1 ppm (weight) ratio of feed iron to antimony (as antimony acetate, 97% wt.) is added to the feed to the FCC, the antimony gradually deposits on the circulating catalyst so that the catalyst which was earliest added becomes the most magnetic, and newly added make-up catalyst is the least magnetic. Operating the same magnetic separator conventionally, causes a sharper recovery of new catalyst because the magnetic susceptibility of the nickel-iron-contaminated catalyst is sharply increased by the antimony depositing on the catalyst. The magnetic susceptibility of the newly added catalyst is virtually zero, whereas the magnetic susceptibility of the catalyst which has been in the unit for several months is approximately 1 to $200\times10^{-6}$ emu/g, giving a sharp difference on which the magnetic separator can operate to provide a separation between older and newer catalyst.

EXAMPLE 2

(The invention incorporating Sb into a high value specialty catalyst additive particle during manufacture)

ZSM-5 and similar catalysts are covered by a number of specialty patents, e.g. U.S. Pat. No. 3,702,886; U.S. Pat. No. 4,229,424; U.S. Pat. No. 4,080,397; EP 94693B1; and U.S. Pat. No. 4,562,055, and is highly favored by the petroleum refining industry because it cracks hydrocarbon feedstocks in such a way as to produce higher octane gasoline in the product. However, ZSM-5 costs approximately 2–4 times the cost of normal cracking catalyst conventionally used for FCC units.

Therefore, it is common practice to add some ZSM-5 particles along with a conventional product, e.g. FOC-90 or other conventional commercial catalyst. When withdrawing metal-contaminated catalyst, some of the ZSM-5 is removed and is conventionally landfilled or otherwise disposed of to waste.

By incorporating 0.01 to 15, more preferably 0.02 to 5, and most preferably 0.03 to 2% by wt. of antimony into the catalyst as it is made, a ZSM-5 catalyst can be "tagged" so that it separates preferentially from the conventional catalyst which does not contain substantial quantities of antimony. As the ZSM-5/antimony tagged catalyst circulates, it is successively contacted with hydrocarbon fuel, separated from the hydrocarbon products, sent through a conventional regenerator to remove carbon, and is separated out (a portion at a time) to a magnetic separator. The magnetic separator preferentially separates the high magnetic susceptibility ZSM-5 catalyst which has had its magnetic susceptibility enhanced by the presence of antimony together with contaminating nickel and iron from the metal-containing hydrocarbon feed.

Alternatively, or supplementally, the highest magnetic fraction from the separator can be further processed through the same or an additional magnetic separator to still further concentrate (beneficiate) the ZSM-5-containing catalyst.

Note that the common practice of adding antimony to FCC feedstocks can be conventionally combined with the invention, though it somewhat decreases the difference in magnetic susceptibility between the catalyst which was tagged with antimony during manufacture and that which was not because both will have some Sb deposited on their surface from the feedstock being cracked.

EXAMPLE 3

(Comparative; the effect on magnetic susceptibility of the presence of iron versus the presence of nickel)

Table 1 sets forth the magnetic susceptibility together with the parts per million of iron, nickel, and antimony for a series of different catalysts, all based on a commercially available petroleum cracking catalyst, FOC-90 manufactured by the Filtrol Division of Akzo Chemicals, Inc., a division of Akzo Nobel.

FIG. 1 plots these same results.

As can be readily seen, the Fe+FOC-90 (4) has a sharply increased magnetic susceptibility over Sb+FOC-90 (2). This increase is enhanced as the nickel increases (3 and 4) When even a lower amount of nickel is added with 600 ppm of antimony (7), the magnetic susceptibility is dramatically increased by a factor of over four. This is only slightly affected by tripling the amount of nickel on the catalyst (6).

Thus, a major discovery of the invention is that antimony together with nickel plus iron is enormously higher in magnetic susceptibility than iron or nickel alone. Thus, adding antimony, e.g. to a feed so that it deposits on a cracking catalyst gradually over time, can effectively sharpen the separation achieved by a magnetic separator operating on the catalyst.

TABLE I

Effect of Sb and Other Metals on Magnetic Susceptibility

| Sample | $Xg^{*}10^{-6}$ emu/g | PPM Fe | Ni | Sb |
|---|---|---|---|---|
| Blank 1 FOC-90-Sb | 0.9 | 4826 | 0 | 700 |
| Blank 2 Fe – FOC-90 + Sb | 1.9 | 11200 | 0 | 490 |
| I. Feed FOC-90 | 1.25 | 4826 | 0 | 0 |
| II. Fe – FOC-90 | 2.2 | 11200 | 0 | 0 |
| III. Fe + Ni (1000) | 4.2 | 11200 | 1200 | 0 |
| IV. Fe + Ni (3000) | 4.4 | 11200 | 3600 | 0 |
| V. Fe + Ni (1000) + Sb | 17.96 | 11200 | 1200 | 600 |
| VI. Fe + Ni (3000) + Sb | 15.72 | 11200 | 3600 | 1900 |

TABLE II

Effect of Antimony Upon Magnetic Susceptibility

| Octex Catalyst | Nickel | Iron | Antimony | Magnetic Susceptibility $X_g \times 10^{-6}$ emu/g |
|---|---|---|---|---|
| 1 | — | 0.0042 | — | 2.89 |
| 2 | — | 0.0042 | 0.0054 | 4.88 |

Further evidence of such interaction between iron and antimony is evident in Table II. As can be seen, without antimony the magnetic susceptibility is at $2.89\times10^{-6}$ emu/g. Whereas with the addition of antimony, the magnetic susceptibility was increased by approximately 69%, thus demonstrating the applicability of this invention.

TABLE III

Compositions (on catalyst particles)

| Parameter | Units | Preferred | More Preferred | Most Preferred |
|---|---|---|---|---|
| Antimony | % by wt. | 0.005–15 | 0.02–5 | 0.03–2 |
| Fe | ppm wt | 10–25,000 | 100–15,000 | 1000–10,000 |
| Ni | ppm wt | 10–15,000 | 100–5000 | 500–3000 |
| V | ppm wt | 10–25,000 | 100–10,000 | 1000–5000 |

All magnetic susceptibilities supported in this application were measured by Mathew-Johnson magnetic susceptibility balance according to techniques recited in U.S. Pat. No. 5,190,635 to Hettinger, col. 6, lines 8–16 (attorney docket 6375BUS).

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. While FOC-90 is used in the Examples, many other commercial catalysts can be used, e.g. Davison/Grace and/or Engelhard.

Reference to documents made in the specification is intended to result in such patents or literature being expressly incorporated herein by reference.

What is claimed is:

1. In a process for the conversion of metals contaminated hydrocarbon feed containing at least one member of the group consisting of Ni, V, Fe and compounds thereof, into lower molecular weight products by contacting feed at above ambient temperatures with particulates comprising catalyst and/or sorbents in a contactor to produce said lower molecular weight products and spent particulates contaminated with feed metals, the improvement comprising in combination:

a) controlling said process to limit Ni on said particulates to 100–5000 wt. ppm Ni on an elemental metal basis;

b) adding antimony over time to said feed and/or to at least a portion of said particulates so that said antimony accumulates in concentration of 0.005–15 wt. % and in an amount sufficient to increase the magnetic susceptibility of said particulates contaminated with feed metals beyond that magnetic susceptibility attributable to said feed metals alone and said antimony acting alone;

c) subjecting said particulates to which antimony has been added to magnetic separation in an magnetic separator which preferentially removes particles of said particulates having higher magnetic susceptibility than the average magnetic susceptibility of said particulates taken as a whole, to form at least a high magnetic susceptibility portion of particulates and a low magnetic susceptibility portion of particulates; and d) recycling at least a portion of said low magnetic susceptibility portion back to said contactor for contact with additional quantities of said feed.

2. A process according to claim 1 wherein at least a portion of said particulates in said mixture comprises iron.

3. A process according to claim 1 wherein at least a portion of said antimony is added by mixing in said feed so as to cause said antimony to deposit gradually over time onto said catalyst.

4. A process according to claim 1 wherein at least a portion of said antimony is included in said particulates during the manufacture of said particulates.

5. A process according to claim 1 wherein said antimony addition increases the magnetic susceptibility of said particulates by at least 69%.

6. A process according to claim 1 wherein said particulates are contaminated with nickel and addition of antimony increases magnetic susceptibility by a factor of over four.

7. A process according to claim 1 wherein sad metal contaminated particulates contain 1200–3600 wt ppm Ni and 600–1900 wt ppm Sb, on a elemental metal basis.

8. A process according to claim 1 wherein the antimony is injected continuously or periodically.

9. A process according to claim 1 wherein the antimony is injected into a catalyst and/or sorbent return line of the contactor.

10. A process according to claim 1 wherein the antimony is injected into a recycle line from the magnetic separator back to the contactor for contact with additional quantities of said feed.

11. The process of any preceding claim wherein said process is controlled to limit Ni on said particulates to 500–3000 wt ppm Ni on an elemental metal basis.

12. The process of claim 1 wherein said particulates contain:

4826 to 11200 ppm Fe;

1200 to 3600 ppm Ni; and 600 to 1900 ppm Sb.

* * * * *